US005351755A

United States Patent [19]

Howlett

[11] Patent Number: 5,351,755

[45] Date of Patent: Oct. 4, 1994

[54] METHOD AND APPARATUS FOR ESTABLISH THE ORIENTATION OF TOOLS IN A CASED BOREHOLE

[75] Inventor: Donald L. Howlett, Kingwood, Tex.

[73] Assignee: Texaco Inc., White Plains, N.Y.

[21] Appl. No.: 100,791

[22] Filed: Aug. 2, 1993

[51] Int. Cl.[5] ..... E21B 47/09

[52] U.S. Cl. ..... 166/250; 166/66; 166/66.5; 166/255; 324/346

[58] Field of Search ..... 166/66, 66.5, 250, 255; 324/346, 221

[56] References Cited

U.S. PATENT DOCUMENTS 2,524,360 10/1950 Russell ..... 324/346
3,288,210 11/1966 Bryant ..... 166/66 X
3,307,642 3/1967 Smith ..... 166/255 X
3,704,749 12/1972 Estes et al. ..... 166/255
4,434,654 3/1984 Hulsing, II et al. ..... 166/255 X
4,465,140 8/1984 Hoehn, Jr. ..... 166/250 X
4,572,293 2/1986 Wilson et al. ..... 166/250
5,233,304 8/1993 Hubans ..... 324/346 X

*Primary Examiner*—Hoang C. Dang
*Attorney, Agent, or Firm*—James L. Bailey; Kenneth R. Priem; Russell J. Egan

[57] ABSTRACT

The steel casing of a well is deliberately magnetized with a known orientation by the passage therethrough of a tool having a demagnetizing section and a magnetizing section along with a gyrocompass section and a magnetic compass section. The casing is first demagnetized and then remagnetized with a polarization which can be determined. The two compasses establish the orientation of the remagnetized casing.

10 Claims, 1 Drawing Sheet

METHOD AND APPARATUS FOR ESTABLISH THE ORIENTATION OF TOOLS IN A CASED BOREHOLE

BACKGROUND OF THE INVENTION

1. The Field of the Invention

The present invention relates to a method and apparatus for deliberately demagnetizing and remagnetizing a casing, situated in a borehole, with a known orientation to facilitate the subsequent orientation of tools passing therethrough.

2. The Prior Art

It is well known that when a hole is bored into the earth, using any known well-drilling method and apparatus, that the bore hole is not perfectly straight nor does it necessarily follow a regular geometric pattern, such as a helix or corkscrew path. Rather the drill bit follows a path generally of least resistance and thus waivers and deviates from a straight line path. Even with the various methods of controlling the drill bit, it is still impossible to drill a completely straight hole. Thus it becomes important to know the orientation of the hole during subsequent operations when, for example, it may be desirable to perforate a well casing in a certain direction.

Also there are some borehole seismic devices, both sources and detectors, which require orientation knowledge. For example, it is very useful to establish the orientation of a three-component geophone receiver deployed in a well in order to know which way the horizontal phones are directed. Magnetic compasses are often used for this purpose in uncased wells, but clearly this approach will not work once the well has been cased with steel pipe. Although gyrocompasses do work well inside steel casings, they are precision mechanical devices that are relatively expensive. The cost to run a gyrotool is around $3,500.00 per day. Since borehole seismic surveys may last from a few days to a week, it is desirable to have a lower cost alternative.

The gyrocompass tools are routinely run once in each well used in a borehole seismic survey in order to precisely survey the coordinates of the borehole as a function of depth. This is necessary because most well bores will not follow a linear path and the bottom of the well may be offset some distance from the surface location.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
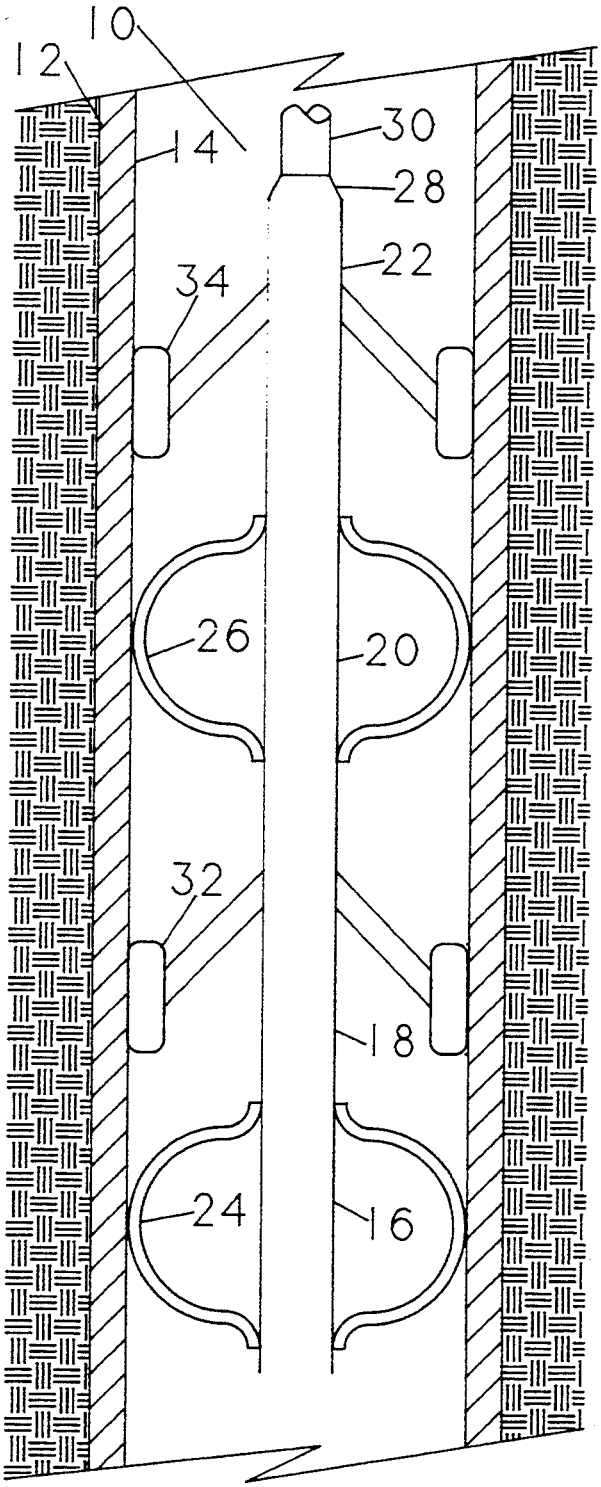
FIG. 1 is a diagrammatic side elevation of the apparatus according to the present invention positioned in a borehole.

Turning first to FIG. 1, the subject tool 10 is shown positioned in the borehole 12 of a well provided with casing 14. The subject tool 10 includes, from the bottom up, a gyrocompass section 16, a depolarizing section 18, a magnetic compass section 20, and a polarizing section 22. The tool 10 is kept generally centered in the well casing by spaced sets of bow springs 24, 26. The upper end of the tool 10 is provided with known connecting means 28 to suspend it from a known logging cable 30, through which the orientation data is telemetered to the surface. The tool 10 is used to measure the true orientation of the casing sections as a magnetic stripe is created.

The lower most gyrocompass section 16 contains any well known gyrocompass, the structure and function of which need not be described in detail. This includes appropriate means (not shown) to telemeter to the surface the orientation information it generates.

The depolarizing section 18 contains a depolarizing electromagnet (not shown) which is coupled to the well casing 14 through arms 32 that are biased out into contact with the inside of the casing. The electromagnet is connected to a power source (not shown) and is controlled to be selectively energized applying a depolarizing magnetic force to the casing.

The magnetic compass section 20 contains any known magnetic compass (not shown). The orientation of this magnetic compass is also relayed to the surface through the logging cable.

The uppermost section of the tool 10 is the polarizing section 22 and contains an electromagnet (not shown) used to permanently magnetize the casing in a known direction. This section is also provided with biased arms 34 making a wiping contact with the inner surface of the casing 14. This electromagnet is also connected to a power source (not shown) and is controlled to be selectively energized to apply a magnetizing force to the casing.

In operation the tool 10 is raised and lowered through the cased borehole in a conventional fashion. An AC current is applied through cable 36 to energize the depolarizing electromagnet 18 which erases any original magnetism in the casing. A DC current is applied to the polarizing electromagnet 22 to permanently remagnetize the casing 14 as the tool 10 moves through the well 12. It is not necessary to orient the magnetic polarity of the casing to any particular direction, for example towards true north. It is only necessary to know the direction in which the casing is being remagnetized. The gyrocompass 16 provides this information. The new magnetic orientation of the casing 14 at regular depth intervals is recorded on the surface. The magnetic compass 20 is not used during the demagnetizing and remagnetizing passes as the magnetic field generated during these operation would clearly cause problems in getting correct readings. It should also be understood that several passes may be necessary to either (or both) demagnetize and/or remagnetize the casing.

Figure 2:
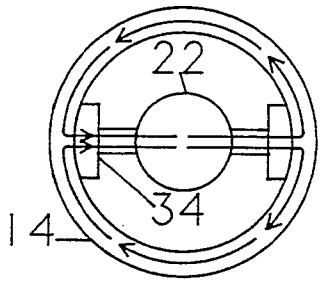
FIGS. 2 and 3 are diagrammatic transverse sections showing the operation of the present invention.

FIG. 2 is a diagrammatic transverse section through the casing 14 and polarizing magnet portion 22 of the present invention 10 with arrows indicating the lines of magnetic flux that are generated to magnetize the casing.

Figure 3:
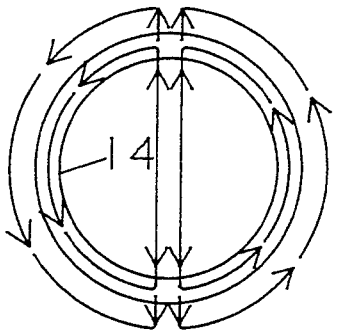

FIG. 3 is a similar diagrammatic transverse section showing the lines of magnetic flux of the casing 14 after the polarization operation and removal of the tool.

As the tool 10 is raised up through the hole, after successful demagnetizing and remagnetizing passes, both the electromagnets 18 and 22 are turned off. The magnetic compass 20 will orient according to the magnetic condition of the casing 14 and this orientation will be compared with the information acquired from the gyrocompass 16 on the trip down to verify that the tool 10 was successful in establishing a definite polarization of the casing 14. The magnetic compass and the gyrocompass will also be compared to obtain a reading of the new magnetized orientation of the casing 14.

After the casing 14 has been prepared in this manner, a simple low-cost magnetic compass (not shown) can be used in combination with any known tool requiring orientation, such as a three-component geophone, which will be subsequently deployed in the cased well.

The present invention is not necessarily limited to the use with three-component geophone tools. There may be other borehole tools which can benefit from knowing the orientation of the cased well.

As pointed out above, it may be necessary to make more than one pass in order to erase the casing's natural magnetization and/or to remagnetize the casing. Thus the present invention should not be considered to be limited to any number of passes for either the demagnetizing and/or remagnetizing operations and these operations need not be equal in number. There is the possibility that individual sections of the casing may require additional passes of one or the other of the two operations. Also, either operation may be carried out while moving the tool either into or out of the well and they may be carried out simultaneously or sequentially as to situation demands.

The present invention may be subject to many modifications and changes without departing from the spirit or essential characteristics thereof. The present embodiment should therefore be considered in all respects as being illustrative and not restrictive as to the scope of the invention as defined by the appending claims.

I claim:

1. A method to establish the orientation of tools in a cased borehole comprising the steps of:

providing a tool having a gyrocompass section, a depolarizing magnet section, a magnetic compass section and a polarizing magnet section;

running said tool through said casing recording its magnetic orientation as noted by said gyrocompass and said magnetic compass;

running said tool through said casing with at least said depolarizing magnet section energized to apply a depolarizing magnetic force to the casing;

running said tool through said casing with at least said polarizing section energized to apply to said casing a polarizing force with a defined magnetic orientation; and running said tool through said casing with both said magnet sections de-energized whereby the magnetic compass will read the new polarized orientation of the casing and the gyrocompass will establish the orientation of said casing with respect to an actual direction.

2. A method according to claim 1 wherein multiple demagnetizing passes are made along at least a portion of said casing.

3. A method according to claim 1 wherein multiple magnetizing passes are made along at least a portion of said casing.

4. A method according to claim 1 wherein said demagnetizing and magnetizing passes are made simultaneously.

5. A tool to establish the orientation of a cased borehole, said tool comprising:

a gyrocompass section;

a depolarizing magnet section;

a magnetic compass section; and a polarizing magnet section whereby the tool passing through a well casing will demagnetize the casing and remagnetize it with the orientation of the subsequently magnetized casing being determined by the relative reading of the magnetic compass and the gyrocompass on pre and post operation passes.

6. The tool according to claim 5 wherein:

said depolarizing magnetic section and said polarizing magnet section each contain an electromagnet selectively connected to a power source for energization.

7. The tool according to claim 6 wherein:

said depolarizing magnet section is connected to an AC power source; and said polarizing magnet section is connected to a DC power source.

8. The tool according to claim 5 further comprising:

means for magnetically coupling the depolarizing electromagnet of said tool to the casing.

9. The tool according to claim 5 further comprising:

means for magnetically coupling the polarizing electromagnet of said tool to said casing.

10. The tool according to claim 5 further comprising:

means to substantially center and stabilize said tool in said casing.

* * * * *